US006387607B1

(12) United States Patent
Chen et al.

(10) Patent No.: US 6,387,607 B1
(45) Date of Patent: May 14, 2002

(54) COMPACT COLOR PHOTOGRAPHIC DEVELOPER CONCENTRATE AND SOLID COMPONENT THEREFOR

(75) Inventors: Yue Chen, Edison; Akira Abe, Fort Lee, both of NJ (US)

(73) Assignees: Fuji Hunt Photographic Chemicals, Inc., Allendale, NJ (US); Fuji Photo Film Co., Ltd. (JP)

( * ) Notice: Subject to any disclaimer, the term of this patent is extended or adjusted under 35 U.S.C. 154(b) by 0 days.

(21) Appl. No.: 09/659,336

(22) Filed: Sep. 12, 2000

(51) Int. Cl.[7] ..... G03C 7/413
(52) U.S. Cl. ..... 430/466
(58) Field of Search ..... 430/466

(56) References Cited

U.S. PATENT DOCUMENTS

| | | | | |
|---|---|---|---|---|
| 4,987,060 | A | 1/1991 | Marchesano | 430/434 |
| 5,273,865 | A | 12/1993 | Loiacono et al. | 430/490 |
| 5,376,510 | A | 12/1994 | Parker et al. | 430/466 |
| 5,837,435 | A | 11/1998 | Abe | 430/490 |
| 5,891,609 | A | 4/1999 | Papai | 430/466 |
| 5,914,221 | A | 6/1999 | Kim et al. | 430/466 |
| 6,017,687 | A | 1/2000 | Darmon et al. | 430/466 |
| 6,043,007 | A | 3/2000 | Abe | 430/403 |
| 6,077,651 | A | 6/2000 | Darmon et al. | 430/466 |

FOREIGN PATENT DOCUMENTS

| | | |
|---|---|---|
| EP | 0800111 | 10/1997 |
| JP | 10333302 | 12/1998 |

OTHER PUBLICATIONS

English Abstract—of Japanese Patent JP 10312036A.
English Abstract—of Japanese Patent JP 10312046.

*Primary Examiner*—Hoa Van Le
(74) *Attorney, Agent, or Firm*—Burns, Doane, Swecker & Mathis, L.L.P.

(57) ABSTRACT

A compact developer concentrate composition for color photographic development that has a reduced number of parts is described. The compact developer concentrate composition includes a concentrate and a coated solid. The coating of the solid remains insoluble in the concentrate, but is easily dissolved upon mixing with water to prepare a replenisher and/or working strength developer. The compact developer concentrate composition is stable, compact, easy to use, has good water solubility upon dilution with water, minimizes mixing errors, and remains free of degradation during long-term storage. A method of processing image-wise exposed photographic color silver halide emulsions using the developer concentrate composition is also provided.

33 Claims, No Drawings

COMPACT COLOR PHOTOGRAPHIC DEVELOPER CONCENTRATE AND SOLID COMPONENT THEREFOR

BACKGROUND OF THE INVENTION

A. Field of the Invention

The present invention relates to a compact photographic color developer concentrate composition comprising a concentrate and a solid component for use in color photographic development of silver halide photographic sensitizing material and a method for processing image-wise exposed silver halide photographic sensitizing materials using the developer concentrate composition.

B. Description of the Related Art

Exposed photographic color silver halide emulsions are generally processed through the steps of color development, de-silvering, washing and stabilization, usually using the following processing solutions: color developer, bleaching solution, fixer, wash water and stabilizing solution. These processing solutions are either prepared from solid chemicals, multi-part liquid concentrates, or diluted, single-part, ready-to-use solutions.

There is a need in the photographic processing industry to reduce the number of multiple liquid concentrates necessary for the preparation of working solutions and replenisher solutions, thus improving the compactness of required materials. At the same time, the long term stability of the materials must be maintained.

For the developer processing step, sets of multiple liquid concentrates are used to prepare the developer replenisher and working strength developer by mixing the liquid concentrates and diluting them with water. This process has found wide-reaching commercial success within the photographic processing industry. A majority of the commercially available photographic processing equipment is based on this system.

In the case of color developers, multiple liquid concentrate parts are necessary due to chemical reactions that occur between hydroxyl amine (HA) and derivatives thereof and p-phenylenediamine and derivatives and salts thereof and the sulfite preservative commonly used when stored together in liquid form. If these chemicals are incorporated into a concentrated solution, the chemical reaction between them proceeds rapidly, severely shortening the shelf life of the composition. Thus, a single concentrated solution that has hydroxyl amine, sulfite preservative and p-phenylenediamine heretofore has not been possible.

In an effort to reduce the number of parts of the developer concentrate, the industry has investigated the use of alternative developer forms and formulations. For example, Abe (U.S. Pat. No. 5,837,435) teaches the use of limited hydroxylamine derivatives in a concentrated solution. However, photographic performance with these derivatives on certain films can produce variations when compared to using hydroxylamine sulfate. In addition, Abe is limited in specific gravity range, thereby not providing compact concentrates.

Kleinschmidt, DE 3106775, discloses a single-part liquid color photographic developer concentrate. However, this developer concentrate requires organic solvents for dissolution to form a replenisher or working developer solution. These solvents also can produce variations on certain films.

Ishida and Koboshi (U.S. Pat. No. 5,480,768) propose the use of solid tablets of chemicals to prevent the chemical interactions that occur in liquid concentrates. Preferably, each chemical should be in the form of a tablet, necessitating the dissolution of multiple tablets to form a developer solution. Using solid tablets of chemicals results in a low dissolution speed of the chemicals in the replenisher or working strength developer. Thus, it is necessary to use water warmed up to around 40° C. to speed dissolution. Warm water-supplying equipment and agitation equipment are required, making solid tablets very difficult to handle in small-scale processing stores (mini- or micro-laboratories). Thus, the solid tablets are disadvantageous because they require special handling and mixing equipment not common in the photographic industry, as opposed to existing processors that allow pourable concentrates to be mixed with water. Because of these disadvantages, the use of tablets has not become widespread within the photographic industry.

Yamashita and Ueda (EP 640,872) also teach a solid photoprocessing composition in the form of a coated tablet. The tablet is coated with one or more of polyalkylene glycol, mono- and di-saccharides or vinyl polymer having a betaine structure to resist abrasion and deterioration. Due to the slow dissolution speed of the tablet coating, the tablets must be added directly to the working solution, again requiring special handling and mixing equipment. In addition, there are many photographic processing chemical components known in the art that are available only as liquids that are excluded from use by this method.

There is a continuing need in the industry to produce a more compact, color developer concentrate that is stable, pourable, easily dissolved, readily mixed in existing photographic processing equipment to prepare both replenisher and working strength developer solutions, and has improved photographic performance and environmental impact, such as using less packaging material thereby reducing the discharge of waste to the environment.

SUMMARY OF THE INVENTION

The present invention provides a stable, pourable photographic developer concentrate composition comprising a concentrate and a solid component. The developer concentrate composition can be used in existing mixing and processing equipment without modification. Further, the developer concentrate composition, concentrate and solid can be formulated using existing and readily available chemicals necessary for photographic processing.

The present invention further provides a single developer concentrate composition in which a concentrate and a solid co-exist or are in contact with each other within the same container. The solid is coated with, or encapsulated in, a material that is insoluble in the concentrate of the developer concentrate composition but is readily and completely soluble when the developer concentrate composition is diluted with water to prepare a replenisher or working strength developer. The developer concentrate composition has excellent storage stability even for extended periods of time at high temperature because chemical components known to react with each other in liquid form are present within the same container without reacting.

In a preferred embodiment, the invention comprises a color developer concentrate composition of a concentrate comprising water and at least one color developer chemical component and a solid comprising at least one color developer chemical component, wherein the solid is isolated from the concentrate by a coating insoluble in the concentrate but readily soluble when diluted with water to prepare a replenisher or working strength developer. Preferably, the concentrate and solid are present in one container. More preferably, the coating comprises an alkali metal sulfate.

In preferred embodiments, the concentrate comprises one or more of a color developer chemical selected from hydroxylamine or a derivative thereof, p-phenylenediamine or a derivative or salt thereof and sulfite. Preferably, the color developer chemical is one or more of a hydroxylamine derivative and sulfite.

In other preferred embodiments, the solid comprises one or more of a color developer chemical selected from hydroxylamine or a derivative thereof, p-phenylenediamine or a derivative or salt thereof and sulfite. Preferably, the color developer chemical is one or more of hydroxylamine or a derivative thereof, more preferably hydroxylamine sulfate, and p-phenylenediamine or a derivative or salt thereof.

In another embodiment, a solid comprises a color developer chemical component comprising at least one color developer chemical suitable for developing silver halide photosensitive materials, and a coating, wherein the coating is insoluble in the concentrate of the developer concentrate composition and is soluble when dissolved with water to prepare a replenisher or working strength developer. In a preferred embodiment, the coating comprises an alkali metal sulfate.

In another embodiment, the solid comprising at least one color developer chemical component is enclosed in a coated tablet or capsule wherein the coating comprises one or more of (a), (b), (c) or (d) as follows:

a. an alkali metal sulfate
b. a polyalkylene glycol having a weight average molecular weight of 1,000 to 20,000;
c. a polyethylene oxide having a weight average molecular weight of 100,000 to 750,000; and
d. a cellulosic polymer having a weight average molecular weight of 10,000 to 1,000,000.

In a preferred embodiment, the solid comprising at least one color developer chemical component is enclosed in a coated tablet or capsule wherein the coating comprises an alkali metal sulfate and one or more of (a), (b) or (c) as follows:

a. a polyalkylene glycol having a weight average molecular weight of 1,000 to 20,000;
b. a polyethylene oxide having a weight average molecular weight of 100,000 to 750,000; and
c. a cellulosic polymer having a weight average molecular weight of 10,000 to 1,000,000.

The invention is further directed to a replenisher and working strength developer made from dilution of the developer concentrate composition in water. A method of processing exposed photosensitive material with the working strength developer is also described.

These and other preferred embodiments are described in detail below.

DESCRIPTION OF THE PREFERRED EMBODIMENT

The color developer concentrate composition of the present invention has a concentrate and a solid component stored in one container such that the concentrate and solid component do not react. The developer concentrate composition is used to form a replenisher or working strength developer by undergoing dilution with water. The developer concentrate composition does not require admixture with any other chemicals in order to form a replenisher or working strength developer.

The concentrate is a solution of water and at least one color developer chemical useful in developing silver halide photographic materials. Herein, "solution" is defined to mean a mixture of two or more ingredients, one of which is water, to form a homogenous liquid. Thus, the concentrate can include a suspension of solids within water or a colloidal mixture.

The concentrate has at least one color developer chemical dissolved or suspended therein. The total amount of color developer chemical present is in an amount of at least about 25% (w/w) by weight of the concentrate, preferably at least about 35% (w/w), more preferably between about 40%(w/w) and about 60% (w/w), and most preferably between about 44% (w/w) and about 52% (w/w). The color developer chemical preferably includes one or more of hydroxylamine or a derivative thereof, p-phenylenediamine or a derivative or salt thereof and a sulfite. If both sulfite and a hydroxylamine derivative are present in the concentrate, the hydroxylamine derivative will be in a form that is stable in the presence of sulfite, such as a long-chain derivative of hydroxylamine. Such derivatives of hydroxylamine that are stable in the presence of sulfite are known to practitioners in the art. Most preferably, the concentrate includes one or more of a sulfite and p-phenylenediamine or a derivative or salt thereof. The concentrate also can contain other suitable color developer chemicals as known to practitioners in the art. The concentrate is formed by any means known to practitioners in the art.

The solid component comprises at least one color developer chemical useful in developing silver halide photographic materials. Preferably, the solid compound of the color developer concentrate composition comprises one or more of hydroxylamine or a derivative thereof, p-phenylenediamine or a derivative or salt thereof and a sulfite. More preferably, the solid comprises one or more of hydroxylamine sulfate and p-phenylenediamine or a derivative or salt thereof. Each of hydroxylamine or a derivative thereof, p-phenylenediamine or a derivative or salt thereof and a sulfite can be present in solution, in the solid, or in both.

Both hydroxylamine or a derivative thereof and sulfite can be present in the solid component. In the concentrate, if both hydroxylamine or a derivative thereof and sulfite are present, the hydroxylamine or derivative thereof must be in a form that is stable in the presence of sulfite, such as a long-chain derivative of hydroxylamine. Such derivatives of hydroxylamine that are stable in the presence of sulfite are known to practitioners in the art.

When the solid component includes hydroxylamine or a derivative thereof, preferably hydroxylamine sulfate, it is in an amount of at least about 30% (w/w) by weight of the solid, preferably at least about 50% (w/w). When the solid includes p-phenylenediamine or a derivative or salt thereof, it is in an amount of at least about 40% (w/w) by weight of the solid, preferably at least about 60% (w/w). When the solid includes more than one of hydroxylamine or a derivative thereof, p-phenylenediamine or a derivative or salt thereof or sulfite, the combined amount is at least about 70% (w/w) by weight of the solid, preferably at least about 85% (w/w). The solid can optionally include other suitable color developer chemicals useful in developing silver halide photographic materials as known to practitioners in the art.

The solid can contain multiple color developer solid chemicals of various particle sizes, including powders, granules and crystals. The solid chemicals are formed into a tablet, encapsulated, or otherwise made into a suitable solid form as known to practitioner in the art by any means known to practitioners in the art. Preferably, a tablet is formed by compression molding the solid color developer chemicals of the solid component. The solid may contain a binding agent as known to practitioners in the art, such as but not limited to polyethylene glycol, to aid in the formation of a tablet or other suitable solid form of the color developer solid chemicals.

A preferable tablet-making process is to form a tablet after granulating the solid color developer chemicals of the solid component. As compared to a solid composition prepared simply by mixing the chemicals to form a tablet, there is an advantage that improved solubility and storage stability are achieved by first granulating the solid color developer chemicals.

Any conventionally known granulation process can be carried out prior to the tablet-making process. The granulation process can be selected from fluidized-bed granulation process, extrusion granulation process, compression granulation process, crush granulation method, fluid-layer granulation process, spray-dry granulation process, or any other granulation process known to practitioners in the art.

Any conventional compression molding machine, such as a single-engined compression molding machine, a rotary-type compression molding machine, a briquetting machine, or the like as known to practitioners in the art can be used to form a tablet. The tablet can be formed in any desirable shape and size, and preferably is suitable for use with existing color photographic development equipment. Preferably, the tablet has a thickness in the range of from about 2 mm to about 8 mm, and a diameter of from about 5 mm to about 15 mm, although smaller or larger tablets can be formed as desired.

A tensile strength of the tablet of about 5 to 50 kg/cm$^2$ is desirable from the viewpoint of manufacturing operation and physical distribution thereof, although tensile strengths outside this range can be used as known to practitioners in the art. If the tensile strength is at least 5 kg/cm$^2$, there are few occurrences of cracking or breaking-off of the tablet during coating as described elsewhere herein.

The solid component is coated with (if in tablet form) or encapsulated in a layer that is insoluble in the concentrate but soluble when diluted with water to form a replenisher or working strength developer. The coating of the solid component may include one or more of an alkali metal sulfate, a polyalkylene glycol having a weight average molecular weight of from about 1,000 to about 20,000, a polyethylene oxide having a weight average molecular weight of from about 100,000 to about 750,000, or a cellulosic polymer having a weight average molecular weight of from about 10,000 to about 1,000,000.

The coating is applied to the solid component in an amount of about 1% (w/w) dry weight to about 50% (w/w) dry weight by weight of the solid component. Preferably, the coating is applied in an amount of about 5% (w/w) dry weight to about 30% (w/w) dry weight by weight of the solid component.

The coating can consist of one or more layers which can be of the same or a different composition, provided at least one layer is insoluble in the concentrate but soluble when diluted with water to form a replenisher or working strength developer. At least one layer of the coating may comprise one or more of an alkali metal sulfate, a polyalkylene glycol having a weight average molecular weight of from about 1,000 to about 20,000, a polyethylene oxide having a weight average molecular weight of from about 100,000 to about 750,000, and a cellulosic polymer having a weight average molecular weight of from about 10,000 to about 1,000,000. In preferred embodiments, at least one layer of the coating contains an alkali metal sulfate.

As used herein, alkali metal sulfates may include any one or more alkali metal sulfate as known to practitioners in the art. Examples of such alkali metal sulfates include, but are not limited to, potassium sulfate, sodium sulfate, and combinations thereof.

Polyalkylene glycols having a weight average molecular weight of from about 1,000 to about 20,000 as used herein include any one or more polyalkylene glycol having a weight average molecular weight of from about 1,000 to about 20,000 known to practitioners in the art. Suitable examples of such polyalkylene glycols include, but are not limited to, Carbowax® PEG (polyethylene glycol) 1450, Carbowax® PEG 4000, Carbowax® PEG 8000, and combinations thereof.

Polyethylene oxides having a weight average molecular weight of from about 100,000 to about 750,000 include any one or more polyethylene oxide (PEO) having a weight average molecular weight of from about 100,000 to about 750,000 known to practitioners in the art. Suitable examples of such polyethylene oxides include, but are not limited to, PEO 100,000, PEO 200,000, PEO 750,000, sulfonated polystyrene 200,000, polyacrylic acid 500.000, and combinations thereof.

Cellulosic polymers having a weight average molecular weight of from about 10,000 to about 1,000,000 include any one or more cellulosic polymer having a weight average molecular weight of from about 10,000 to about 1,000,000 as known to practitioners in the art. Suitable examples of such cellulosic polymers include, but are not limited to, methyl cellulose, hydroxy ethyl cellulose, hydroxypropyl methyl cellulose, and combinations thereof.

One or more alkali metal sulfate can be present in the coating in an amount of from about 1% (w/w) dry weight to about 50% (w/w) dry weight by weight of the solid component, preferably in an amount of from about 5% (w/w) to about 30% (w/w), more preferably in an amount of from about 10% (w/w) to about 25% (w/w), and most preferably in an amount of from about 10% (w/w) to about 20% (w/w). Preferably, the alkali metal sulfate is sodium sulfate, potassium sulfate, or a combination thereof. One or more of a polyalkylene glycol, a polyethylene oxide or a cellulosic polymer as described herein can be present in the coating in an amount of from about 1% (w/w) dry weight to about 8% (w/w) dry weight by weight of the solid component, preferably in an amount of about 1% (w/w) to about 5% (w/w). Preferably, a cellulosic polymer is present in an amount of from about 1% (w/w) dry weight to about 5% (w/w) dry weight by weight of the solid component. The combined weight of all coating layers should not exceed 50% (w/w) dry weight by weight of the solid component, preferably 30% (w/w) dry weight by weight of the solid component.

In the present invention, exemplary methods for coating the solid component in tablet form are given below. Other methods of coating the tablet as recognized by practitioners in the art can also be used. Preferable methods of coating the tablet include: dipping the tablet into the coating material made liquid by heating or dissolving in a solvent; coating the tablet with the coating material made liquid by dissolving in a solvent or heating; and spraying the coating made liquid by dissolving in a solvent or heating onto the surface of the tablet.

Coating by a continuous process such as spraying followed by drying is preferable in order to increase production speed at manufacture of the solid component. Spraying or pan coating are preferable methods of coating when multiple layers of coating are to be used.

Alternately, the solid component can be encapsulated by the coating material as described herein by any suitable method as known to practitioners in the art.

Suitable derivatives and salts of p-phenylenediamine for use in the invention include:

4-amino-3-methyl-N-ethyl-N-(β-(methanesulfonamido) ethyl)aniline,
N,N-diethyl-p-phenylenediamine,
N,N-diethyl-p-phenylenediamine monohydrochloride,
N,N-diethyl-p-phenylenediamine sulfur dioxide complex,
N,N-diethyl-p-phenylenediamine sulfate,
2-amino-5-diethylamino-toluene,
4-amino-N-ethyl-N-(α-methanesulphonamidoethyl)-m-toluidine,
4-amino-N-ethyl-N-(β-methanesulphonamidoethyl)-m-toluidine sesquisulfate monohydrate,
4-amino-3-methyl-N-ethyl-N-(α-hydroxy-ethyl)-aniline,
4-amino-3-(α-methylsulfonamidoethyl)-N,N-diethylaniline,
4-amino-N,N-diethyl-3-(N'-methyl-α-methylsulfonamido)-aniline,
N-ethyl-N-methoxy-ethyl-3-methyl-p-phenylenediamine,
N-ethyl-N-(β-hydroxyethyl)-p-phenylenediamine sulfate,
4-amino-3-methyl-N,N-diethylaniline,
4-amino-3-methyl-N-ethyl-N-(3-hydroxypropyl)aniline,
4-amino-N-ethyl-N-(2-hydroxyethyl)aniline,
4-amino-3-methyl-N-ethyl-N-(2-hydroxyethyl)aniline,
4-amino-3-methyl-N-ethyl-N-(2-hydroxyethyl)aniline sulfate,
4-amino-3-methyl-N-ethyl-N-(2-methanesulfonamidoethyl) aniline,
2-amino-5-diethylaminotoluene hydrochloride,
N-(2-amino-5-N,N-diethylaminophenylethyl) methanesulfonamide,
N,N-dimethyl-p-phenylenediamine,
4-amino-3-methyl-N-ethyl-N-(2-methoxyethyl)aniline,
4-amino-3-methyl-N-ethyl-N-(4-hydroxybutyl)aniline,
4-amino-3-methyl-N-ethyl-N-(2-butoxyethyl)aniline,
4-amino-N-ethyl-N-(2-methoxyethyl)-m-toluidine di-p-toluene sulfonate, and the like, and salts thereof. Other suitable salts and derivatives of p-phenylenediamine are known to practitioners in the art.

Other color developing chemicals as known to practitioners in the art can be included in either the concentrate or the solid. These can include, but are not limited to, for example, buffering agents, antioxidants, chelating agents, antifoggants, development accelerators or restrainers, surfactants, and the like.

One or more buffering agents as known to practitioners in the art can be present in one or more of the concentrate or solid in order to maintain the pH of the replenisher and working strength developer upon dilution of the developer concentrate composition in water. Suitable pH control agents include, but are not limited to, inorganic alkali metal hydroxides, alkali metal carbonates, and the like. In the art, useful alkali metal hydroxides include lithium, sodium and potassium hydroxide. Useful alkali metal carbonates include lithium, sodium and potassium carbonates. The buffering agent may be present in an amount up to about 33% (w/w) of the concentrate weight, or in an amount of less than about 10% (w/w) of the solid weight. If present in both, the total amount of buffering agent does not exceed about 36% of the total weight of the concentrate and solid. Practitioners in the art will recognize that other suitable amounts outside these ranges may also be used.

One or more inorganic or organic antioxidants as known to practitioners in the art can be added to the concentrate or solid as a preservative to protect the color developing agent. These compounds are preferably added to the concentrate in an amount of about 2% to about 7% of the concentrate weight, or to the solid in an amount of less than about 10% of the solid weight. The total amount of antioxidants in the developing concentrate composition does not exceed about 7% of the total weight of the concentrate and solid, although other suitable amounts outside these ranges can be used as recognized by practitioners in the art.

Various chelating agents as known to practitioners in the art can be present in one or more of the concentrate or solid component of the color developer concentrate composition as precipitation inhibitors of calcium or magnesium in the replenisher or working strength developer, or as stability improving agents of the developer concentrate composition. Examples of suitable chelating agents include, but are not limited to, nitrilotriacetic acid, diethylenetriaminepentaacetic acid, ethylenediaminetetraacetic acid, N,N,N-trimethylenephosphonic acid, ethylenediamine-N,N,N',N'-tetramethylenesulfonic acid, transcyclohexanediaminetetraacetic acid, 1,2-diaminopropanetetraacetic acid, glycol ether diaminetetraacetic acid, ethylenediamine-o-hydroxyphenylacetic acid, 2-phosphonobutane-1,2,4-tricarboxylic acid, 1-hydroxyethylidene-1,1-diphosphonic acid, N,N'-bis(2-hydroxybenzyl)ethylenediamine-N,N'-diacetic acid and 1,2-dihydroxybenzene-4,6-disulfonic acid. Chelating agents may be used in combinations of two or more, if desired. The amount of the chelating agent in the color developer concentrate composition should be sufficient to sequester Group II and transition metal ions present in the dilution water used to prepare the replenisher or working strength developer.

Other additives such as antifoggants, alkanolamines, development accelerators, development restrainers, wetting agents, fragrances and surfactants, for example, as known to practitioners in the art, can optionally be included in one or more of the concentrate or solid. Amounts of each additive suitable for use in the concentrate and/or solid of the invention are readily determinable by practitioners in the art.

The silver halide color photosensitive material to which the present invention is applicable is a photosensitive material which can be processed with a color developer containing a sulfite. Specific examples of such materials include silver chlorobromide emulsion- or silver bromide emulsion-coated color papers and color auto positive papers, and silver iodobromide emulsion-coated color negative films, color reversal films and color reversal papers. Of these materials, color negative films are preferred for use with the present invention.

The concentrate and solid of the invention are desirably enclosed in a single container or package such that the concentrate is in contact with the solid and opening or rupturing of the container causes both the concentrate and solid to be exposed or released. The concentrate and solid forming the color developer concentrate composition are contained by any suitable means known in the art for wrapping or packaging of developer concentrate compositions, including, but not limited to, packages of film, plastic, coated paper, aluminum, or any combination thereof. Preferably, the developer concentrate composition is packaged in a manner suitable for use with existing color photographic developing equipment, in particular, with automatic feeding equipment used in color photographic processing systems.

A method for processing an image-wise exposed photographic color silver halide emulsion using the developer concentrate composition disclosed herein includes mixing the developer concentrate composition with water to form a working strength developer, and processing the exposed photosensitive material with the working strength developer. While the processing parameters are known to practitioners in the art, preferably the process is carried out for about 20 seconds to about 4 minutes at a temperature of from about 30–50° C. Other suitable processing methods and parameters which may be used with the developer concentrate composition described herein will be apparent to practitioners in the art.

Use of the above process with the developer concentrate composition of the invention for developing image-wise exposed photographic color silver halide emulsions avoids the possibility of mixing errors inherent in using conventional sets of multiple liquid concentrates which must be mixed in a specific addition order prior to use. In the process of the invention, the developer concentrate composition may be either manually added by pouring into the replenisher tank containing dilution water at prescribed intervals, or it can be metered into the replenisher tank with water based on the actual quantity of photographic material processed, or based on some measured property of the process bath such as, for example, the specific gravity or pH of the working strength developer, the concentration of depleted components therein as determined by chemical analysis, the accumulation of decomposition products, the accumulation of extracts from the photographic material, other properties known to practitioners in the art, or any combination of the foregoing.

To form a replenisher, the color developer concentrate composition described herein is diluted with water such that the developer concentrate composition is present in water in an amount up to about 8% (w/w), preferably in an amount of from about 4.5% to about 7.5%. To form a working strength developer, the color developer concentrate composition described herein is diluted with water such that the developer concentrate composition is present in water in an amount up to about 8% (w/w), preferably in an amount of from about 2.0% to about 7.5%.

Multiple solid components can be used within the developer concentrate composition used to form a replenisher or working strength developer. When multiple solid components are used, each solid component can have the same or a different chemical composition.

The use of solid components having different chemical compositions in a single concentrate allows various chemicals known to react when stored together to be stored in a single package over long periods of time without reacting. Thus, hydroxylamine or derivatives thereof, p-phenylenediamine or derivatives or salts thereof and sulfite may be stored in a single container or package, but each contained in a different solid component such that they do not react during storage. This minimizes the number of containers required for handling, eases addition of chemicals for forming replenishers or working strength developers because only one container or package of chemicals is needed, and greatly improves the shelf life of the developer chemicals.

EXAMPLES

Examples of the present invention are given below by way of illustration only.

Preparation Example 1

A concentrate useful for forming a replenisher or working strength developer for processing color negative film as known to practitioners in the art was prepared according to the following formula:

TABLE I

| | |
|---|---|
| Water | 51 g |
| Diethylenetriaminepentaacetic acid, pentasodium salt, 41% | 8.80 g |
| hydroxylamine-N,N-diethylenesulfonic acid, disodium salt | 2.25 g |
| Sodium sulfite | 4.50 g |
| Potassium Bromide | 1.20 g |
| Potassium Carbonate | 33.4 g |
| Total solid chemicals | 44.96 g (44.5% w/w) |

A color negative film developer replenisher as known to practitioners in the art was prepared by adding the above concentrate to 980 ml water, then adding 3.2 g of hydroxyl amine sulfate (HAS) and 6.2 g of 4-amino-3-methyl-N-ethyl-N-[β-(hydroxy)ethyl]aniline sulfate (CD4).

Preparation Example 2

A suspension concentrate for forming a replenisher or working strength developer for preparing a color negative film as known in the art was prepared by adding 6.2 g of CD4 to the concentrate prepared in Preparation Example 1 (Table I) with agitation for 20 minutes. The temperature of the mixture was controlled not to exceed 40° C. during preparation. A suspension of solid particles in the suspension concentrate was formed.

A color negative film developer was prepared by adding the above suspension concentrate and 3.2 g of HAS to water sufficient to form one liter of replenisher.

Example 1

The solubility of some water soluble solid polymers and alkali metal sulfate salts was tested in the concentrate and the replenisher of Preparation Example 1. The results are shown in Table II. Solubility was determined by visual observation of the mixture of polymer or salt and concentrate or replenisher. Solubility was rated as follows:

soluble—mixture was substantially free of solid salt or polymer partially soluble—mixture contained visible amount of solid of salt or polymer after mixing insoluble—substantially all polymer or salt remained as solid

TABLE II

| | solubility in the concentrate | | solubility in the replenisher | |
|---|---|---|---|---|
| Polymer | 20° C. | 38° C. | 20° C. | 38° C. |
| Gum Arabic | soluble | soluble | soluble | soluble |
| Methyl Cellulose | insoluble | insoluble | soluble | partially soluble |
| Hydroxy Ethyl Cellulose > 10K | insol. - swelled | insol. - swelled | soluble | soluble |
| Hydroxypropyl Methyl Cellulose | insol. | insol. | soluble | soluble |
| PEG 1450 | insol. | insol. | soluble | soluble |
| PEG 4000 | insol. | insol. | soluble | soluble |
| PEG 8000 | insol. | insol. | soluble | soluble |
| PEG 20K | insol. | insol. | soluble | soluble |
| PEO 100K | insol. | insol. | soluble | soluble |
| PEO 200K | insol. | insol. | soluble | soluble |

TABLE II-continued

| Polymer | solubility in the concentrate 20° C. | solubility in the concentrate 38° C. | solubility in the replenisher 20° C. | solubility in the replenisher 38° C. |
|---|---|---|---|---|
| PEO 750K | insol. | insol. | soluble | soluble |
| Sulfonated Polystyrene 200K | insol. | insol. | soluble | soluble |
| Polyacrylic Acid 500K | insol. | insol. | soluble | soluble |
| Potassium Sulfate | insol. | insol. | soluble | soluble |
| Sodium Sulfate | partially sol. | partially sol. | soluble | soluble |

Polymers or alkali metal sulfate salts that were insoluble in the concentrate but soluble in the replenisher were selected as materials useful for hydroxyl amine sulfate (HAS) and CD4 encapsulation or tablet coating.

Example 2

3.2 g of HAS crystals were encapsulated into each of 4 VEGICAP® size 0 capsules (hydroxypropyl methyl cellulose based capsules made by CAPSUGEL®). The HAS capsules were added to the concentrate of Preparation Example 1. After storage for 200 days at 22° C. or 50° C., no decomposition of the HAS capsules had occurred.

Preparation Example 3

HAS Tablet Preparation 100 g of hydroxyl amine sulfate and 20 g of polyethylene glycol were mixed in a V-blender for 5 minutes. The resulting mixture then was compression-tableted by a tablet press (Model M16, manufactured by Key International, Inc., NJ, USA). Each pressed HAS tablet weighed 0.9 g.

HAS Tablet Coating

A first coating solution was made by mixing 76.74 g of water, 11.66 g sodium sulfate and 8.74 g potassium sulfate until a uniform coating solution was formed. The first coating solution was spray coated onto the HAS tablets made as described above using a Lab Development Coating System (LDCS) manufactured by Vector Corporation, USA. A second coating solution was made by mixing 3.6 g of hydroxy ethyl cellulose polymer (weight average molecular weight range of about 10,000 to about 1,000,000) and 41.4 g water until a uniform coating solution was formed. The second coating solution was spray coated onto the HAS tablets coated with the first coating using LDCS.

Thus, the HAS tablets were coated by a first coating layer comprising 17% (w/w) dry weight sodium and potassium sulfate by weight of the uncoated HAS tablet and a second coating solution layer comprising 3% (w/w) dry weight hydroxy ethyl cellulose polymer by weight of the uncoated HAS tablet.

Example 3

Samples containing four (4) coated HAS tablets as prepared in Preparation Example 3 added to the suspension concentrate of Preparation Example 2 were prepared. As a control, samples containing four (4) un-coated HAS tablets added to the suspension concentrate were also prepared. The samples were stored at 22° C. or 50° C. and the stability of each sample over time was determined. At the end of a testing period, each sample was diluted with water to make one liter of color negative film developer replenisher. The concentrations of sodium sulfite and hydroxylamine sulfate in the replenisher corresponding to each sample were analyzed. The results are shown in Table III.

TABLE III

| Testing time (day) | Sodium sulfite, g/L 22° C. Un-coated tablets | Sodium sulfite, g/L 22° C. Coated tablets | Sodium sulfite, g/L 50° C. Un-coated tablets | Sodium sulfite, g/L 50° C. Coated tablets | HAS, g/L 22° C. Un-coated tablets | HAS, g/L 22° C. Coated tablets | HAS, g/L 50° C. Un-coated tablets | HAS, g/L 50° C. Coated tablets |
|---|---|---|---|---|---|---|---|---|
| 0 | 5.25 | 5.25 | 5.25 | 5.25 | 3.00* | 3.00* | 3.00* | 3.00* |
| ¼ | 5.10 | — | 3.57 | — | 2.98 | — | 1.80 | — |
| 5 | 3.32 | 5.18 | 0.81 | 5.1 | 1.80 | 2.93 | 0.1 | 2.87 |
| 40 | 1.32 | 5.13 | 0.59 | 5.07 | 0.48 | 2.84 | 0.13 | 2.92 |
| 60 | — | 5.00 | — | — | — | 2.65 | — | — |

*Initial theoretical concentration with four HAS tablets.

— Indicates amount not measured because either 1) too soon to effect change in concentration or 2) amount of sodium sulfite or HAS already dropped below acceptable levels.

As shown in Table III, the stability of sodium sulfite and HAS is very poor if the HAS is not protected by a coating layer, particularly at higher storage temperatures. For example, after 5 days, the HAS level in replenishers made from un-coated tablets decreased to unacceptable levels, even when the sample was kept at room temperature (22° C.) during storage. As can be seen from the results in Table III, the coated tablets of the invention significantly improved the stability of sodium sulfite and HAS when stored together over time.

Preparation Example 4

HAS/CD4 Co-tabletting 36 g of hydroxyl amine sulfate, 62 g of CD4 and 20 g of polyethylene glycol were mixed in a V-blender for 5 minutes. The resulting mixture then was compression-tableted by a tablet press (Model M16, manufactured by Key International, Inc., NJ, USA). Each pressed HAS/CD4 tablet had a weight of 0.9 g.

HAS/CD4 Tablet Coating

The HAS/CD4 tablets were coated by the same method as described in Preparation Example 3. Thus, the HAS/CD4 tablets were coated by a first coating solution layer comprising 17% (w/w) dry weight sodium and potassium sulfate by weight of the uncoated HAS/CD4 tablet and a second coating solution layer comprising 3% (w/w) dry weight hydroxy ethyl cellulose polymer by weight of the uncoated HAS/CD4 tablet.

Example 4

12 coated HAS/CD4 tablets were added to the concentrate of Preparation Example 1. The sample was stored at 22° C.

in order to determine stability. After 130 days, the HAS/CD4 was still in the tablet form protected by the coating materials. The concentrate remained a clear, uniform liquid solution.

Example 5

In order to determine the protective effectiveness of the coatings described herein against dissolution of the solid in the concentrate of the developer concentrate composition, tablets of HAS/CD4 as described in Preparation Example 4 were prepared with various coatings for comparison to uncoated HAS/CD4 tablets prepared as described in Preparation Example 4.

HAS/CD4 tablets coated with 17% (w/w) dry weight sodium and potassium sulfate by weight of the uncoated HAS/CD4 tablet and 3% (w/w) dry weight hydroxy ethyl cellulose polymer by weight of the uncoated HAS/CD4 tablet, as described in Preparation Example 4, were sealed in a plastic bag then placed in a humidity chamber at 40° C. and 70% relative humidity. HAS/CD4 tablets coated with 20% (w/w) dry weight Carbowax® PEG 8000 by weight of the uncoated HAS/CD4 tablet were also placed in the humidity chamber under the same conditions, as were uncoated HAS/CD4 tablets. In less than 24 hours, the uncoated HAS/CD4 tablets were severely discolored black. After two weeks, the tablets coated with Carbowax® PEG 8000 were severly discolored black, while tablets coated with sodium and potassium sulfates and hydroxy ethyl cellulose polymer were not discolored. Thus, tablets coated with a mixture of alkali metal sulfates and hydroxy ethyl cellulose provided better protection against dissolution of the tablet in the concentrate than tablets coated with Carbowax® PEG 8000 alone, and tablets coated with Carbowax® PEG 8000 exhibited better protection against dissolution in the concentrate than uncoated tablets.

Example 6

In order to determine the protective effectiveness of the coatings described herein against dissolution of the solid in the concentrate of the developer concentrate composition, tablets of HAS as described in Preparation Example 3 were prepared with various coatings for comparison to uncoated HAS tablets prepared as described in Preparation Example 3.

HAS tablets as produced in Preparation Example 3 were coated with a first layer of Carbowax® PEG 8000, then further coated as described in Preparation Example 3. Thus, the HAS tablets were coated with a first layer of 3% (w/w) dry weight Carbowax® PEG 8000 by weight of the uncoated HAS tablet, a second layer of 17% (w/w) dry weight sodium and potassium sulfates by weight of the uncoated HAS tablet and a third layer of 3% (w/w) dry weight hydroxy ethyl cellulose polymer by weight of the uncoated HAS tablet.

The coated tablets were added to the concentrate of Preparation Example 1 and samples were placed in storage at 22° C., 40° C. and 50° C. After 145 days, all coated tablets remained in solid tablet form. In comparison, HAS tablets coated with 20% by weight Carbowax® PEG 8000 collapsed in the concentrate within 1 day at 50° C., 2 days at 40° C. and 7 days at 22° C. Uncoated tablets collapsed on contact with the concentrate of Preparative Example 1 at 50° C. or 40° C., and within one day at 22° C. Thus, the multi-layer coating of polyethylene glycol, alkali metal sulfate and hydroxy ethyl cellulose polymer effectively isolated solid HAS tablets from reacting with sulfites dissolved in the concentrate, while the coating of Carbowax® PEG 8000 increased the shelf life of the coated HAS tablets in concentrate at room temperature over that of uncoated tablets.

As shown by the above examples, a stable single part photographic color developer concentrate composition can be formed with a concentrate containing a one or more solid, such as HAS tablets, CD4 tablets or HAS/CD4 co-tablets, wherein the solid is protected from reacting with the concentrate by use of one or more coating materials as described and illustrated herein.

While this invention has been described with respect to particular embodiments thereof, it is apparent that numerous other forms and modifications of the invention will be obvious to those skilled in the art. This invention should be construed to cover all such obvious forms and modifications known to practitioners in the art which are within the true spirit and scope of the present invention as set forth in the appended claims.

We claim:

1. A color developer concentrate composition comprising:

a concentrate comprising water and at least one color developer chemical; and a solid comprising at least one color developer chemical wherein the solid is isolated from the concentrate by a coating insoluble in the concentrate but readily soluble when diluted with water to prepare a replenisher or working strength developer.

2. The color developer concentrate composition of claim 1, wherein the at least one color developer chemical of the concentrate is in an amount of at least about 25% (w/w) of the concentrate.

3. The color developer concentrate composition of claim 1, wherein the at least one color developer chemical of the concentrate is in an amount of at least about 35% (w/w) of the concentrate.

4. The color developer concentrate composition of claim 1, wherein the total amount of the at least one color developer chemical of the concentrate is in an amount of from about 40% (w/w) to about 60% (w/w) of the concentrate.

5. The color developer of claim 1, wherein the coating is in an amount of from about 1% (w/w) of the solid to about 50% (w/w) of the solid.

6. The color developer of claim 1, wherein the coating is in an amount of from about 5% (w/w) of the solid to about 30% (w/w) of the solid.

7. The color developer concentrate composition of claim 1, wherein the coating comprises at least one compound selected from the following (a), (b), (c) and (d):

a. an alkali metal sulfate;

b. polyalkylene glycol having a weight average molecular weight of from about 1,000 to about 20,000;

c. a polyethylene oxide having a weight average molecular weight of from about 100,000 to about 750,000; and d. a cellulosic polymer having a weight average molecular weight of from about 10,000 to about 1,000,000.

8. The color developer of claim 7, wherein the coating comprises an alkali metal sulfate.

9. The color developer of claim 8, wherein the alkali metal sulfate in the coating is in an amount of from about 5% (w/w) of the solid to about 30% (w/w) of the solid.

10. The color developer of claim 8, wherein the alkali metal sulfate in the coating is in an amount of from about 10% (w/w) of the solid to about 25% (w/w) of the solid.

11. The color developer concentrate composition of claim 1, wherein the solid is in the form of a tablet or capsule having a thickness of from about 2 mm to about 8 mm and a diameter of from about 5 mm to about 15 mm.

12. The color developer concentrate composition of claim 1, wherein at least one color developer chemical of the solid is selected from hydroxylamine or a derivative thereof, p-phenylenediamine or a derivative or salt thereof, and sulfite.

13. The color developer concentrate composition of claim 1, wherein at least one color developer chemical of the solid is selected from hydroxylamine sulfate and p-phenylenediamine or a derivative or salt thereof.

14. The color developer concentrate composition of claim 1, wherein at least one color developer chemical of the concentrate is selected from hydroxylamine or a derivative thereof, p-phenylenediamine or a derivative or salt thereof, and sulfite.

15. The color developer concentrate composition of claim 1, wherein at least one color developer chemical of the concentrate is selected from a hydroxylamine derivative and sulfite.

16. The color developer concentrate composition of claim 1, wherein the concentrate and solid are contained in one container such that the concentrate is in contact with the solid.

17. The color developer concentrate composition of claim 1, wherein the coating comprises one or more layers.

18. The color developer concentrate composition of claim 17, wherein at least one of the one or more coating layers comprises at least one compound selected from the following (a), (b), (c) and (d):

a. an alkali metal sulfate;

b. a polyalkylene glycol having a weight average molecular weight of from about 1,000 to about 20,000;

c. a polyethylene oxide having a weight average molecular weight of from about 100,000 to about 750,000; and d. a cellulosic polymer having a weight average molecular weight of from about 10,000 to about 1,000,000.

19. The color developer concentrate composition of claim 1, wherein more than one solid is present in the concentrate.

20. A color developer concentrate composition comprising:

a concentrate comprising water and at least one color developer chemical; and a solid comprising at least one color developer chemical wherein the solid is isolated from the concentrate by a coating insoluble in the concentrate but readily soluble when diluted with water to prepare a replenisher or working strength developer, wherein the coating comprises an alkali metal sulfate.

21. The color developer concentrate composition of claim 20, wherein the at least one color developer chemical of the concentrate is present in an amount of at least about 25% (w/w) of the concentrate.

22. The color developer concentrate composition of claim 20, wherein the at least one color developer chemical of the concentrate is present in an amount of at least about 35% (w/w) of the concentrate.

23. The color developer concentrate composition of claim 20, wherein the total amount of the at least one color developer chemical of the concentrate is in an amount of from about 40% (w/w) to about 60% (w/w) of the concentrate.

24. The color developer concentrate composition of claim 20, wherein the coating further comprises at least one compound selected from the following (a), (b) and (c):

a. polyalkylene glycol having a weight average molecular weight of from about 1,000 to about 20,000;

b. a polyethylene oxide having a weight average molecular weight of from about 100,000 to about 750,000; and c. a cellulosic polymer having a weight average molecular weight of from about 10,000 to about 1,000,000.

25. The color developer of claim 20, wherein the coating is in an amount of from about 1% (w/w) of the solid to about 50% (w/w) of the solid.

26. The color developer of claim 20, wherein the coating is in an amount of from about 5% (w/w) of the solid to about 30% (w/w) of the solid.

27. The color developer of claim 20, wherein the alkali metal sulfate in the coating is in an amount of from about 5% (w/w) of the solid to about 30% (w/w) of the solid.

28. The color developer concentrate composition of claim 20, wherein at least one color developer chemical of the solid is selected from hydroxylamine or a derivative thereof, p-phenylenediamine or a derivative or salt thereof, and sulfite.

29. The color developer concentrate composition of claim 20, wherein at least one color developer chemical of the solid is selected from hydroxylamine sulfate and p-phenylenediamine or a derivative or salt thereof.

30. The color developer concentrate composition of claim 25, wherein at least one color developer chemical of the concentrate is selected from hydroxylamine or a derivative thereof, p-phenylenediamine or a derivative or salt thereof, and sulfite.

31. The color developer concentrate composition of claim 25, wherein the coating comprises one or more layers.

32. A process for developing color negative film, the process comprising:

diluting a color developer concentrate composition in water up to an amount of about 8% (w/w) to form a working strength developer; and processing the exposed photosensitive material with the working strength developer wherein the color developer concentrate composition comprises:

a concentrate comprising water and at least one color developer chemical; and a solid comprising at least one color developer chemical wherein the solid is isolated from the concentrate by a coating insoluble in the concentrate but readily soluble when diluted with water to prepare the working strength developer.

33. A process for developing color negative film, the process comprising:

diluting a color developer concentrate composition in water up to an amount of about 8% (w/w) to form a working strength developer; and processing the exposed photosensitive material with the working strength developer wherein the color developer concentrate composition comprises:

a concentrate comprising water and at least one color developer chemical; and a solid comprising at least one color developer chemical wherein the solid is isolated from the concentrate by a coating insoluble in the concentrate but readily soluble when diluted with water to prepare the working strength developer, wherein the coating comprises an alkali metal sulfate.

* * * * *